US007363823B2

(12) United States Patent
Brice

(10) Patent No.: US 7,363,823 B2
(45) Date of Patent: Apr. 29, 2008

(54) TWIN-HEADED TOOTHBRUSH

(75) Inventor: Michael F. Brice, Syosset, NY (US)

(73) Assignee: NMOC, LLC, Minneapolis, MN (US)

( * ) Notice: Subject to any disclaimer, the term of this patent is extended or adjusted under 35 U.S.C. 154(b) by 118 days.

(21) Appl. No.: 11/179,310

(22) Filed: Jul. 11, 2005

(65) Prior Publication Data

US 2005/0246847 A1 Nov. 10, 2005

Related U.S. Application Data

(63) Continuation of application No. 10/326,664, filed on Dec. 23, 2002, now abandoned, which is a continuation-in-part of application No. 09/596,081, filed on Jun. 16, 2000, now abandoned.

(51) Int. Cl.
*G01N 3/20* (2006.01)

(52) U.S. Cl. ..... 73/846; 73/862.041; 73/862.042; 73/862.043; 15/105

(58) Field of Classification Search ..... 73/849, 73/862.041–862.043; 15/105
See application file for complete search history.

(56) References Cited

U.S. PATENT DOCUMENTS

| | | | |
|---|---|---|---|
| 18,653 | A | 11/1857 | Wadsworth |
| 715,263 | A | 12/1902 | Haussmann |
| 860,840 | A | 7/1907 | Strassburger |
| 1,389,624 | A | 9/1921 | Carroll |
| 1,565,750 | A | 12/1925 | Nathanson |
| 1,668,216 | A | 5/1928 | Noel |
| 1,679,785 | A | 8/1928 | Quinn |
| 1,679,946 | A | 8/1928 | Ruff |
| 1,748,895 | A | 2/1930 | Noel |
| 1,868,368 | A | 7/1932 | Reese |
| 1,908,509 | A | 5/1933 | Davis |
| 1,928,328 | A | 9/1933 | Carpentier |
| 2,077,392 | A | 4/1937 | Boyd |
| 2,164,219 | A | 6/1939 | McGerry |
| 2,242,743 | A | 5/1941 | Brown |
| 2,266,195 | A | 12/1941 | Hallock |
| 2,528,992 | A | 11/1950 | Barr |
| 3,129,449 | A | 4/1964 | Cyzer |
| 3,152,349 | A | 10/1964 | Brennesholtz |
| 3,193,864 | A | 7/1965 | Makowsky |
| 3,350,737 | A | 11/1967 | Makowsky |

(Continued)

FOREIGN PATENT DOCUMENTS

| | | |
|---|---|---|
| DE | 818794 | 5/1952 |

(Continued)

*Primary Examiner*—Edward Lefkowitz
*Assistant Examiner*—Freddie Kirkland, III
(74) *Attorney, Agent, or Firm*—Patton Boggs LLP

(57) ABSTRACT

A toothbrush includes: a handle shaped and dimensioned to be grasped by a human hand; necks coupled to the handle; bristle supports coupled to the necks; and bristles coupled to the bristle supports. The toothbrush, through the bristles coupled to the bristle supports and the necks, is configured to adapt to a dento-gingival junction and all other changing surfaces encountered during brushing to disrupt plaque. The necks provide (i) resistance above 0.35 kilograms of brushing pressure force and (ii) resiliency below 3.77 kilograms of brushing pressure force. The bristles, the necks, and the bristle supports, in combination, provide (i) resistance above 0.55 kilograms of brushing pressure force and (ii) resiliency below 3.89 kilograms of brushing pressure force.

33 Claims, 6 Drawing Sheets

U.S. PATENT DOCUMENTS

| | | | | | |
|---|---|---|---|---|---|
| 3,691,587 | A | | 9/1972 | Makowsky | |
| 3,742,549 | A | | 7/1973 | Scopp et al. | |
| 3,953,907 | A | | 5/1976 | Froidevaux | |
| 4,333,199 | A | | 6/1982 | Del Rosario | |
| 4,403,623 | A | | 9/1983 | Mark | |
| 4,449,266 | A | | 5/1984 | Northemann et al. | |
| 4,472,853 | A | | 9/1984 | Rauch | |
| 4,476,604 | A | * | 10/1984 | White et al. | 15/105 |
| 4,488,328 | A | | 12/1984 | Hyman | |
| 4,638,520 | A | | 1/1987 | Eickmann | |
| 4,667,360 | A | | 5/1987 | Marthaler et al. | |
| 4,691,405 | A | | 9/1987 | Reed | |
| 4,716,614 | A | * | 1/1988 | Jones et al. | 15/105 |
| 4,776,054 | A | | 10/1988 | Rauch | |
| 4,796,325 | A | | 1/1989 | Bortman | |
| 4,864,676 | A | | 9/1989 | Schaiper | |
| 4,876,157 | A | | 10/1989 | Barman | |
| 5,121,520 | A | * | 6/1992 | Brice | 15/167.1 |
| 5,146,645 | A | * | 9/1992 | Dirksing | 15/167.1 |
| 5,305,491 | A | | 4/1994 | Hegemann | |
| 5,355,544 | A | * | 10/1994 | Dirksing | 15/105 |
| 5,493,747 | A | * | 2/1996 | Inakagata et al. | 15/22.1 |
| 5,499,421 | A | * | 3/1996 | Brice | 15/167.1 |
| 5,735,012 | A | * | 4/1998 | Heinzelman et al. | 15/167.1 |
| 5,875,510 | A | | 3/1999 | Lamond et al. | |
| 5,987,690 | A | * | 11/1999 | Heuler | 15/167.1 |
| 6,112,361 | A | * | 9/2000 | Brice | 15/167.1 |
| 6,327,734 | B1 | * | 12/2001 | Meginniss et al. | 15/105 |
| 6,425,295 | B1 | * | 7/2002 | Meginniss | 73/862.046 |
| 6,532,818 | B2 | * | 3/2003 | Blankenship | 73/579 |
| 6,536,068 | B1 | * | 3/2003 | Yang et al. | 15/105 |
| 6,546,802 | B2 | * | 4/2003 | Shiraishi et al. | 73/579 |
| 6,786,732 | B2 | * | 9/2004 | Savill et al. | 434/263 |
| 6,884,947 | B2 | * | 4/2005 | Cipriani | 177/245 |
| 7,059,202 | B2 | * | 6/2006 | Stanos et al. | 73/862.044 |
| 2003/0135944 | A1 | * | 7/2003 | Brice | 15/167.1 |

FOREIGN PATENT DOCUMENTS

| | | |
|---|---|---|
| DE | 3703288 | 8/1988 |
| DE | 4115943 | 11/1991 |
| FR | 642976 | 9/1928 |
| FR | 855253 | 5/1940 |
| FR | 2618651 | 2/1989 |
| FR | 2641680 | 7/1990 |
| GB | 247005 | 2/1926 |
| GB | 2192784 | 1/1988 |
| IT | 594027 | 5/1959 |
| JP | 286708 | 12/1991 |
| WO | 13691 | 7/1993 |

* cited by examiner

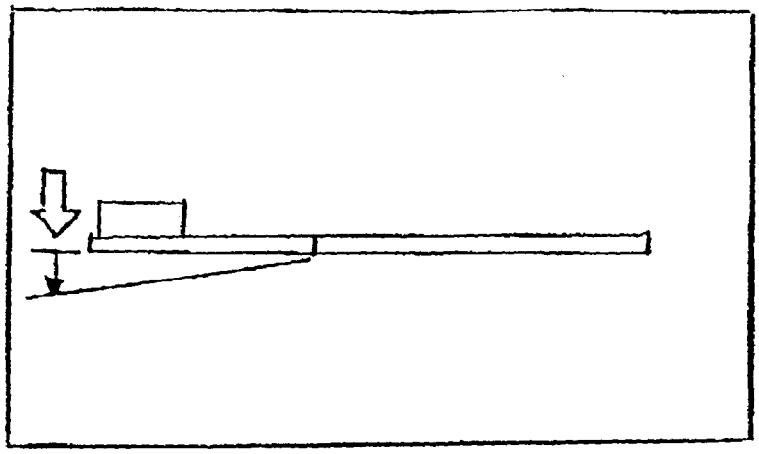
Fig. 6 The Y Value
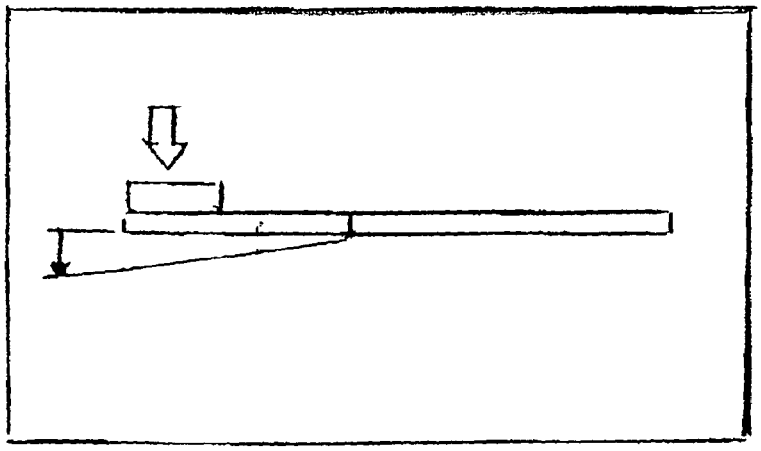
Fig. 7 The Z Value
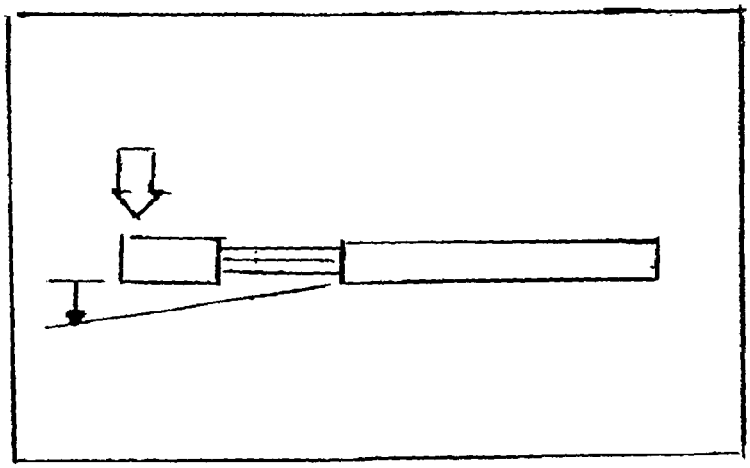
Fig. 8 The L Value

TWIN-HEADED TOOTHBRUSH

CROSS-REFERENCE TO RELATED APPLICATION

This application is a continuation of U.S. patent application Ser. No. 10/326,664 filed Dec. 23, 2002 now abandoned, which is a continuation-in-part of U.S. patent application Ser. No. 09/596,081, filed Jun. 16, 2000 now abandoned, both entitled "Twin-Headed Toothbrush, both of which are herein incorporated by reference.

BACKGROUND

This invention relates to toothbrushes. More particularly, this invention relates to contour adaptive toothbrushes.

As disclosed in U.S. Pat. Nos. 5,121,520 and 5,499,421 issued to the present inventor, Michael Brice, the disclosures of which are incorporated herein by reference, to effectively clean teeth and gum areas complex maneuvering of a toothbrush is necessary. It is generally acknowledged that the great majority of individuals brush their teeth and gum surfaces primarily in a horizontal and semi-circular manner, even though this particular technique is not deemed to be the best way of cleaning the teeth and gum surfaces. There are two reasons why most individuals resort to this ineffective technique. First, conventional brushing heads are not particularly designed to follow the contours of the teeth and gum surfaces, and as an extension of the human arm do not permit complicated and exact maneuvers to be performed. Second, most brushing takes place in the early morning when one first arises and in the evening just prior to retiring. This is a factor, as demanding complicated procedures for this time of day and night are beyond the tolerance of most individuals. For these reasons, most individuals resort to a simple natural horizontal or semi-circular conventional brushing technique.

Numerous attempts have been made in the past as shown, for example, in U.S. Pat. No. 860,840 to Strassburger, U.S. Pat. No. 3,742,549 to Scopp et al., and U.S. Pat. No. 4,67,360 to Marthaler et al. to improve the design of the toothbrush such as the bristles and/or the head. U.S. Pat. No. 860,840 to Strassburger discloses a toothbrush having two rows of bristles sloped in opposite directions relative to each other, and a central section of bristles arranged parallel to and located between the two outside rows. However, these prior toothbrushes do not simultaneously and/or independently accommodate different contours of the teeth.

In other patents, adjacent head portions of a toothbrush are made to pivot or flex relative to the handle portion so that the bristles are better able to conform to the contours of the teeth and gum surfaces. Such an arrangement is shown in U.S. Pat. No. 928,328 to Carpentier, U.S. Pat. No. 2,266,195 to Hallock, U.S. Pat. No. 3,152,349 to Brennesholtz, U.S. Pat. No. 4,333,199 to Del Rosario, U.S. Pat. No. 4,488,328 to Hyman, U.S. Pat. No. 4,691,405 to Reed, and U.S. Pat. No. 4,776,054 to Rauch. More particularly, U.S. Pat. No. 4,333,199 to Del Rosario and U.S. Pat. No. 4,488,328 to Hyman disclose a toothbrush having a single discreet brushing head that can be pivoted about the handle. The Del Rosario patent, in addition, discloses a brushing head that can rotate about three planes.

U.S. Pat. No. 1,928,328 to Carpentier, U.S. Pat. No. 2,266,195 to Hallock, U.S. Pat. No. 3,152,349 to Brennesholtz and U.S. Pat. No. 4,691,405 to Reed show a toothbrush head capable of flexing or articulating relative to the handle. Specifically, the brushing head comprises a plurality of serially arranged flexing head segments, wherein the segments flex in union or relative to each other.

Finally, U.S. Pat. No. 4,776,054 to Rauch discloses a toothbrush head having three arranged brushing segments, whereby the central segment is aligned with the handle and the two segments on either side are symmetrically arranged relative to the central segment. The bristles on the outer sides of the Rauch patent have narrow, blade-like, contact points which are likely to induce excessive pressure to the gum due to the narrow contact points. In other words, the narrow blade-like bristles inherently place higher excessive concentrated pressure on the gum more so than bristles with a larger contact area.

None of these toothbrushes are directed to overcoming ineffective brushing techniques, or the individual's anatomically limited abilities to effectively clean the curvilinear surfaces of the teeth and provide for gentle stimulation of the varying gum tissues without harm or discomfort for the user, for example, by utilizing side-by-side arranged brushing heads.

In addition, none of these toothbrushes provide for the discreet functioning of one or more brushing heads as separate elements by addressing the force exerted by the user (hereinafter "the X Value"), the resistance/resiliency characteristics of the molecular density of the material used in conjunction with the structural dimensions of the toothbrush (hereinafter "the Y Value"), in concert with the resistance/resiliency of the bristle body as separate functioning elements of the uniform bristle body mass (hereinafter "the Z Value"), as well as the lateral resistance characteristics of the one or more necks (hereinafter "the L Value").

Moreover, none of these toothbrushes enables the varying of the brushing pressure, in accordance with the proclivity of the user, in order to prevent excessive pressure from being applied to the gums and/or gingival tissue or from injury to the tooth enamel.

BRIEF DESCRIPTION OF THE DRAWINGS

FIGS. 6-8 shows force diagrams to address and understand the Y, Z, and L values.

DETAILED DESCRIPTION

Figure 1:
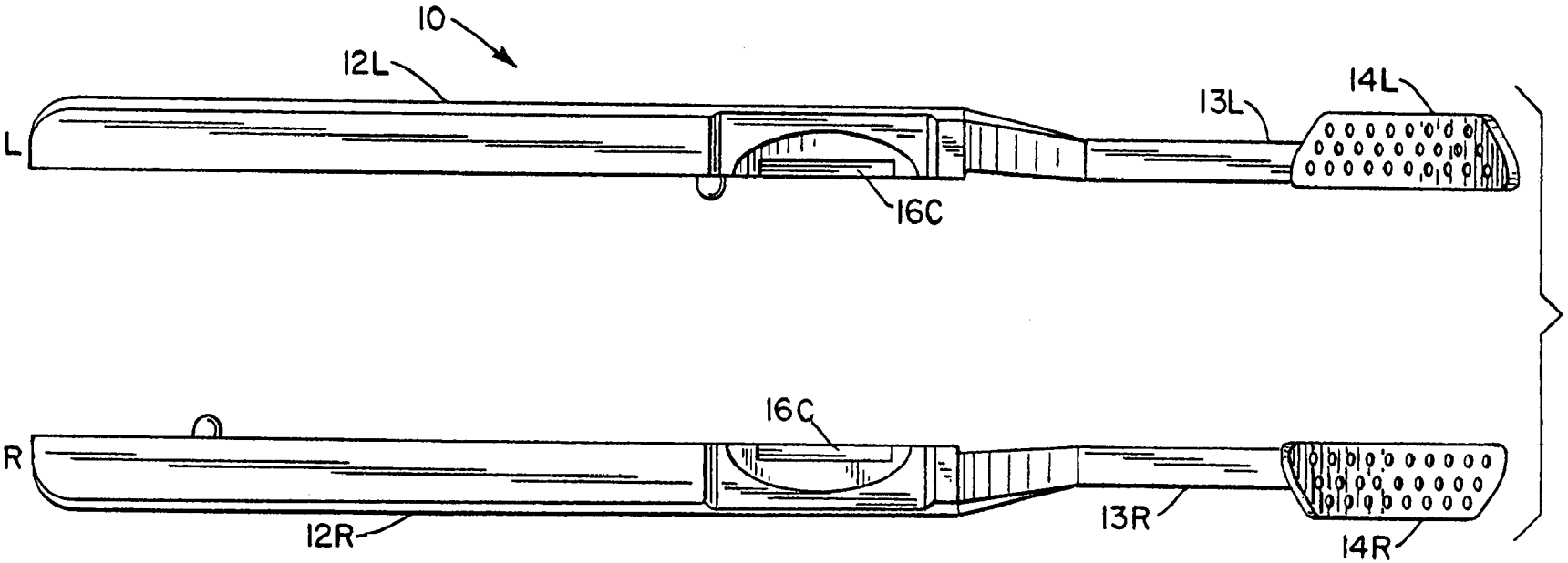
FIG. 1 shows a top view of the left and right side handles of one embodiment of a toothbrush.

Presently, it is only generally known that a neck or a head of a toothbrush can be "resilient." To achieve full contour-adaptivity of a toothbrush, however, specific forces, resistances and resiliencies of the toothbrush have to be addressed and understood. As a result, full "functioning" of a toothbrush has not been possible as the dynamic-interaction between a user and the toothbrush, as well as the forces, resistances and resiliencies of the toothbrush, have not been addressed, appreciated and/or understood.

One embodiment of a toothbrush includes one or more necks and/or uniform bristle body mass offering resistance and then providing resiliency as to brushing forces as may be applied to achieve full contour-adaptivity of the toothbrush. One can appreciate the toothbrush from the standpoint of a machine having moving parts wherein the force and/or energy of the user is harnessed (the power source) and the moving parts of the toothbrush are dependent upon the understanding of degree of force over a range of user variants and what is required to resist such force and at what point or value of such force in which such resistances incorporated into the toothbrush become resilient. Full functioning of the toothbrush is not possible without this knowledge and the lack of such knowledge prevents any toothbrush from realizing dynamic contour adaptivity that provides workability and full functionality for the user in the application and use of the toothbrush. Therefore, merely stating that a toothbrush is resilient does not provide any degree of knowledge as to what is required on the part of the toothbrush to function.

The embodiment of toothbrush may provide resistance to the brushing force by the flexible neck portions to the degree that such one or more necks resist such force and then become resilient to such force based upon the resistance/resiliency characteristics of the neck structures meeting obstructions. The separate and combined neck structures also provide contour-adaptivity by being directly related to the resistance and resiliency characteristics of the one or more bristle body heads. The resistance/resiliency of the bristle body heads is related to the neck structures, and may correspond to the force(s) exerted by the user. The bristle body heads may be configured to provide resistance to the changing curvilinear structures encountered during brushing.

The toothbrush may then achieve proper functioning of its one or more brushing heads, and provide alternate addressing and penetration of the dento-gingival junction of the tooth/teeth/gum structures (e.g., the gingival margin) so as to respond independently with the inside and adjacent rows of bristles of each head in maintaining contact and orientation to such gingival-margin areas of each individual during brushing. The toothbrush also may provide an instrument for cleaning teeth and gingival tissue that enables a user to achieve correct tooth brushing pressure. In addition, the toothbrush may include one or more heads that respond to the pressure exerted by the user to enable effective tooth/gingival tissue cleaning, without tooth or gingival damage. Furthermore, the toothbrush may be configured to coordinate the brushing force of a user (designated as "the X Value") with the structural dimensions and the molecular density of the materials of the toothbrush (designated as "the Y Value"), in conjunction and concert with the one or more discreet and combined bristle body mass offering resistance and resiliency characteristics (designated as "the Z Value").

The toothbrush may include: a handle to be grasped by a human hand; a first neck extending from the handle; a second neck extending from the handle parallel to the first neck; a first bristle support attached to the first neck; a second bristle support attached to the second neck; a plurality of first bristles extending from the first bristle support; and/or a plurality of second bristles extending from the second bristle support. The plurality of first and second bristles may be formed of a stiffness. The first and second necks may be formed of a predetermined resiliency, flexibility and bending resistance. The value of the stiffness relative to the predetermined resiliency, flexibility and bending resistance may be set in accordance with a predetermined brushing force to be applied by the bristles to achieve the full functioning of the one or more articulating heads in making and maintaining contact with the dento-gingival junction.

The embodiments described herein have been included for purposes of illustrating the principals of the present invention. Accordingly, the present invention is not limited to the configurations and constructions as illustrated and/or set forth herein.

Also, throughout the illustrations of different embodiments, the same or equivalent elements have been identified with the same reference numerals.

Figure 2:
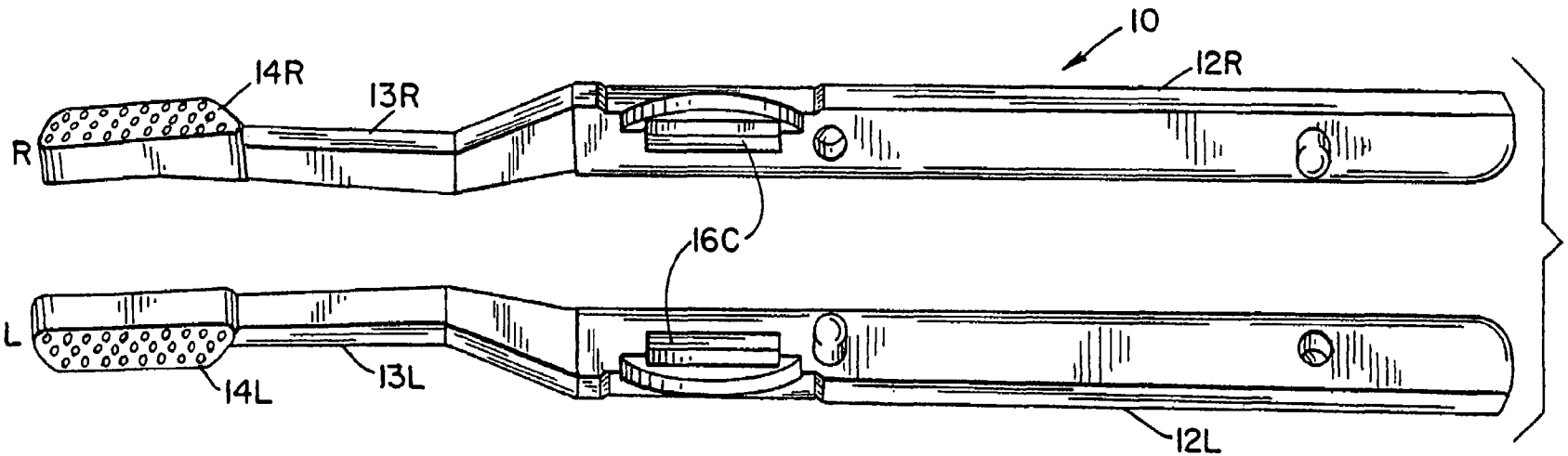
FIG. 2 shows a side view of the left and right side handles in which the handles are slightly turned to enable a partial view of the top of the left and right side handles of the toothbrush in FIG. 1.
Figure 3:
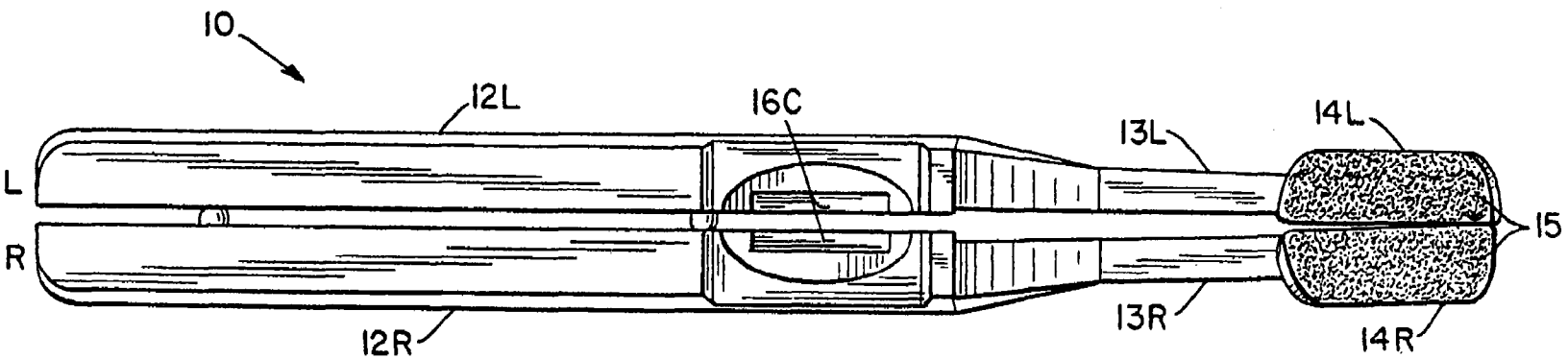
FIG. 3 shows a top view similar to FIG. 1.

FIGS. 1-3 show one embodiment of the left (L) and right (R) handles of a dual headed toothbrush 10. Conventional molding equipment may be used to form the integral right handle (R) and integral left handle (L). The right and left handles may include handles 12L and 12R, neck portions 13L and 13R and/or the brushing heads 14L and 14R. The right and left handles may be molded polymers of amorphoric resins and/or semicrystalline resins. The heads may be held flat to drill holes for the brushes and plug bristles 15 into the holes (see FIG. 3). The bristles have a stiffness, which can range from soft to hard to vary the resiliency and resistance presented by the bristles to the teeth and gums during brushing. The bristles may be cut to any desired length, shape and/or profile, and polished in accordance with commercially known techniques.

The left and right handles may be brought together and welded along the handles 12L and 12R by conventional bonding and welding techniques. For example, the Branson Ultrasonic Corporation, manufactures and sells commercial vibrational and ultrasonic welding machines capable of welding various types of plastics.

As discussed above, the toothbrush is configured to be dependent upon understanding and addressing the force exerted by the user in brushing his or her teeth ("the X Value"), meeting the resistance, resiliency characteristics of the molecular density of the material used in conjunction with the structural dimensions of the neck elements ("the Y Value"), achieving alternate functioning of the brushing heads in concert with the resistance/resiliency characteristics of the discreet and combined uniform bristle body mass ("the Z Value") in maintaining contact with the dento-gingival junction with the inside and adjacent rows of bristles of each independently articulating brushing head. Addressing each of these factors (values), and the elements for carrying out each of these factors, provides for the proper functioning characteristics of the toothbrush.

Figure 1B:
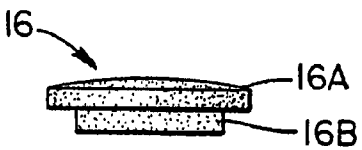
FIGS. 1A and 1B show the insert of the toothbrush in FIG. 1.
Figure 1A:
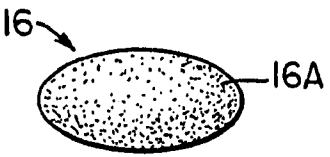
Figure 4:
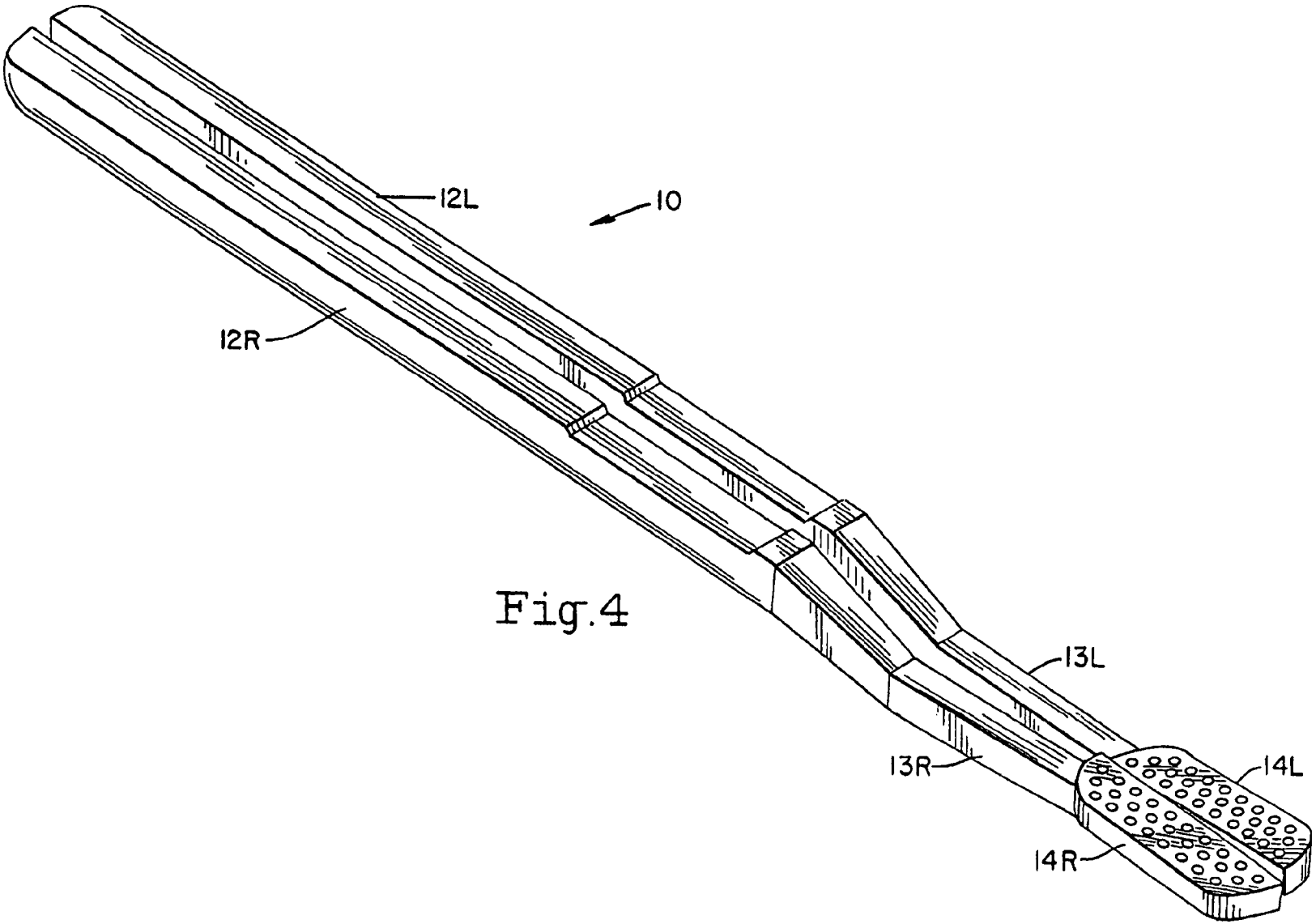
FIG. 4 shows a view of another embodiment of a toothbrush, with the left and right handles being slightly separated.
Figure 5:
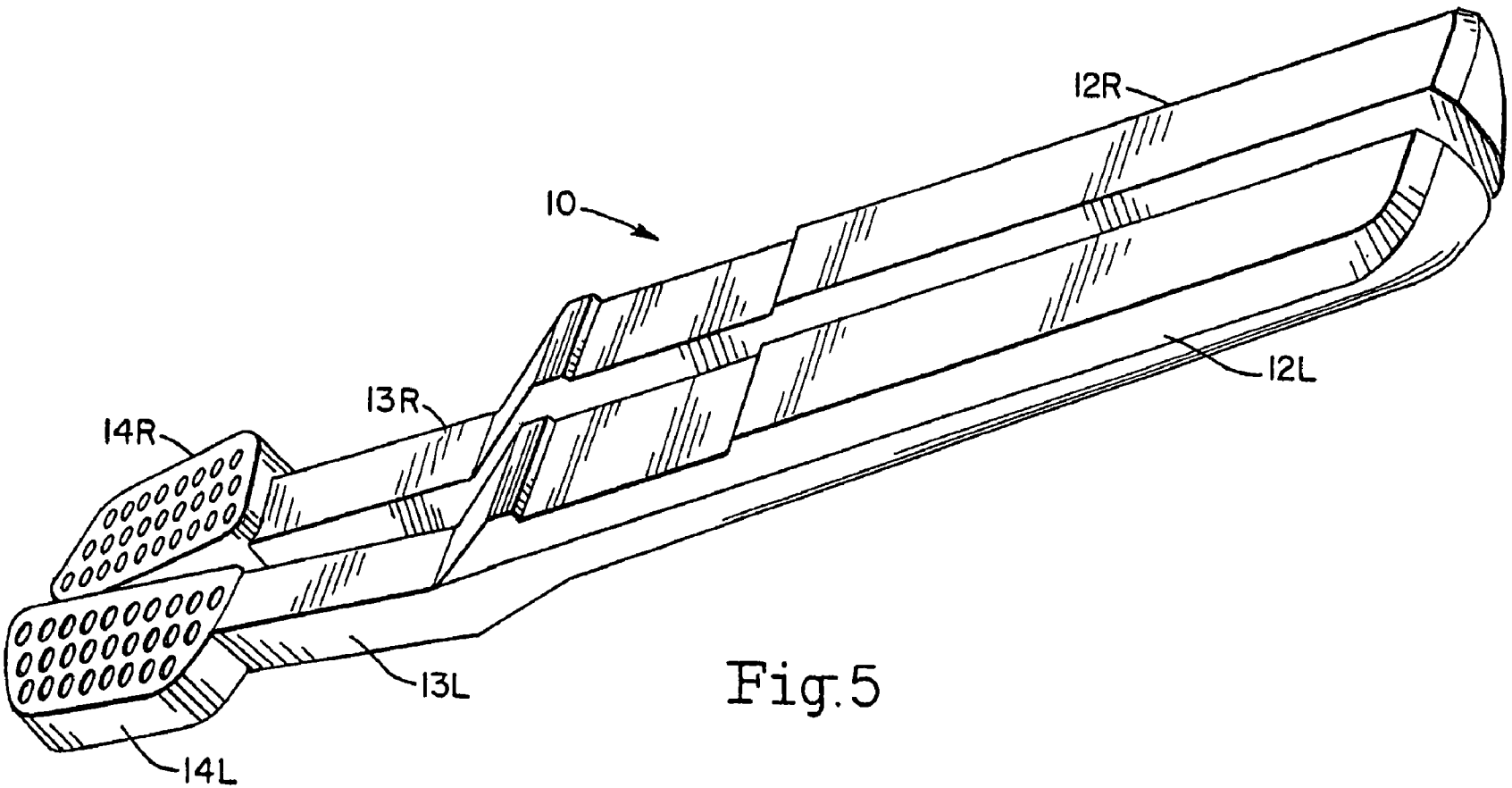
FIG. 5 shows a view of the toothbrush in FIG. 4.

The toothbrush is dependent on characteristics of necks 13L and 13R, and brush heads 14L and 14R to achieve the proper functioning of the toothbrush. Moreover, the toothbrush can work (function) with the use of a cushioned insert 16 in the handle (see FIGS. 1A and 1B). The embodiments of FIGS. 4 and 5 illustrate the toothbrush without the use of a cushioned insert 16.

The inclusion of the cushioned insert, which can be made of a rubber having a stiffness which varies from soft to hard can increase the sensitivity for the user. The increase in sensitivity occurs as a result of the pressure transmitted by the user through the thumb being totally or partially absorbed by said insert. The insert can be of any shape or design which fits into a similarly shaped cavity provided in the left and right handles. The insert 16 is shown to have an oval top. Moreover, the oval shaped inset 16 is provided with a rectangular base 16B. The rectangular base 16B slides into a rectangular cavity 16C formed during the molding operation of the left and right handles. A suitable adhesive may be used to hold the rectangular base 16A of insert 16 in cavity 16C of the handles. Thereafter the bonding of the left and right handles may insure the permanent retention of insert 16 in the finished toothbrush. Also, the insert may be made of rubber and shaped to accommodate the thumb of the user. The resiliency characteristics of the rubber can be varied to accommodate the pressure exerted on the brush through the thumb of the user. Thus the stiffness of the rubber insert can be varied from soft to hard to provide a range of cushioning characteristics.

Further, the polymers used to make the left and right handles can be selected to increase or decrease the flexibility, resiliency and resistance of the necks 13L and 13R of the left and right handles. Similarly, the stiffness of the bristles 15 of the brushing heads 14L and 14R can be selected to range from soft to hard to vary the resiliency and resistance presented by bristle to the teeth and gum of the user.

The embodiments of the toothbrush provide for the adaptation of the toothbrush to the changing surfaces of the differing tooth/teeth/gingival structures of the user encountered during brushing by the one or more self-responding, self articulating brushing heads (see FIG. 10). Addressing and understanding the X, Y, Z and L values allow for the full, proper and safe functioning of the toothbrush.

The independent contour-adaptivity of the one or more brushing heads is dependent upon critical and exact understanding of the forces involved during brushing:

X-Value=force of the user;

Y-Value=resistance/resiliency of the one or more necks (resistance to force/load);

Z-Value=the resistance/resiliency of the one or more bristle heads working in conjunction with the one or more necks; and/or L-Value=Lateral resistance characteristics of the one or more necks combined.

Method of Determining Forces, Resistances & Resiliencies

All laboratory testing utilized the Digital Force & Torque Gauge supplied by the Mark 10 Corporation of Hicksville, New York. The model used for this testing is the Series EG20 Digital Force Gauge, which is calibrated in pounds, kilograms and/or millinewton. Such compression determination was calibrated in kilograms for establishing the necessary and exact forces, resistances and resiliencies for the functioning requirements of the toothbrush. FIG. 6 illustrates the Certificate of Calibration supplied by the Mark 10 Corporation for model No. EG20, Serial No. 41629, dated Oct. 11, 2002.

All calibrations were completed using a fixture constraining each flexible/resistant element in a fixed position (see FIGS. 6-8) wherein such forces were applied either (1) deflecting such bristle uniform masses to 50% of their natural fixed vertical orientation and (2) wherein such measurements were established deflecting necks to ⅜ths from their "natural" fixed molded positions. FIG. 6 is a diagram that illustrates measuring the neck structure(s) being deflected ⅜ths inch at the tip of the head opposite the handle from a resting position. FIG. 7 is a diagram that illustrates measuring the Z value by the head and neck structure(s) combined being deflected from the tip of the head(s) ⅜ths of an inch downward from a resting position. FIG. 8 is a diagram that illustrates measuring the L valve by a lateral force being applied on the side of a head and/or neck structures to deflect the head ⅜ths of an inch from a resting position.

Calibration of forces (1): (Y Value) Initial resistance, then subsequent resiliency of the neck structures. The method employed here concerned having the handle portion of the toothbrush fixed in a holding fixture replicating the handle being grasped by a human hand and, allowing the necks (unsupported, as it would be in normal brushing) to deflect and/or flex to a degree of ⅜ths of an inch off of their "natural" fixed and/or molded position upon such force that would yield their deflecting to this ⅜ths of an inch (see FIG. 6). Such deflecting (⅜ths of an inch) allows the toothbrush to achieve optimum contour-adaptivity of all surfaces encountered during brushing and, in particular, the achieving of contacting and removing plaque from the dento-gingival junction of all individuals using the toothbrush.

Calibration of forces (2): (Z Value) Vertical deflecting to 50% of fixed (without any pressure being applied) vertical orientation of such bristle body mass and/or structure(s) wherein such pressure was applied to deflect such bristle body mass(es) to 50% off of vertical. This method provides the degree of resistance necessary to derive the degree of force required to produce such deflection. The bristle-body mass, upon 50% of deflection, provides the Z Value (see FIG. 7).

Calibration of forces (3): (X Value) All calculations here utilized establishing the average force applied by the average user of toothbrushes, single-headed or otherwise. These calculations incorporated gauging what force was required to deflect such bristle structure/masses to 50% off their "natural" vertical orientation. Additionally, the same method as described in (1) above was used where each different handle was constrained in said fixture replicating the same holding orientation of the average user of a toothbrush allowing the necks and/or neck element of the toothbrush to deflect the same ⅜ths of an inch off of their normal fixed positions to replicate the average movement range occurring during "normal" brushing.

Calibration of forces (4): (L Value) Lateral resistance/resiliency of the individual and/or combined neck structures of the toothbrush. These calibrations were determined having the individual neck segments/structures fixed as described in (1) and (3) above wherein such force was applied allowing each segment to deflect laterally, again, ⅜ths of an inch replicating the movement of the brush head(s) combined as the individual uses the "upward and downward" movement during brushing (see FIG. 8). (This movement being distinct from the individual brushing into and out of the oral cavity in a fashion horizontal and parallel to the tooth/teeth/gum structures). The "upward and downward" movement of the average individual incorporates using the toothbrush going from the top of the palatal structures of teeth and to the bottom of the lower jaw tooth/teeth/gum structures in such "upward and downward" motion.

Force, Resistance & Resiliency Values

The average force exerted by the user on a toothbrush is from 1.05 to 2.35 kg of brushing force. Such pressure force exerted deflects the bristle body mass to 50% of vertical orientation.

The following values were derived from deflecting the neck structures (Y-Value) ⅜ths of an inch from their fixed molded position. The heads and necks combined (Z-Value) were also deflected ⅜ths of an inch from their fixed positions. The lateral calculations (L-Value) also were deflected ⅜ths of an inch from their fixed positions.

The operational range of 5 different variations of a toothbrush follows:

| | Y-Value | Z-Value | L-Value | |
|---|---|---|---|---|
| 1st Variation | 1.80 kg | 1.95 kg | 1.93 kg | Resistant Value |
| 2nd Variation | 1.42 kg | 1.63 kg | 1.47 kg | " |
| 3rd Variation | .68 kg | .84 kg | .78 kg | " |
| 4th Variation | .35 kg | .55 kg | .65 kg | " |
| 5th Variation | .83 kg | 1.05 kg | 1.19 kg | " |

While the above values represent embodiments of the toothbrush establishing the ranges of full-functioning, contour-adaptivity, the following stated values represent the additional ranges in which the toothbrush can still operate and achieve full range contour-adaptivity.

Values for resiliency follows:

| Y-Value | Z-Value | L-Value |
|---|---|---|
| 3.68 kg | 3.89 kg | 3.77 kg |

The range of X, Y, Z, and/or L values of one embodiment of a toothbrush may be:

X-Value=1.70 kilograms of pressure force exerted by user (Average);

Y-Value=resist above 0.35 kg of pressure force and are resilient below 3.68 kg pressure force;

Z-Value=resist above 0.55 kg of pressure force and are resilient below 3.89 kg pressure force;

L-Value=resist above 0.65 kg of pressure force and are resilient below 3.77 kg pressure force.

Figure 9:
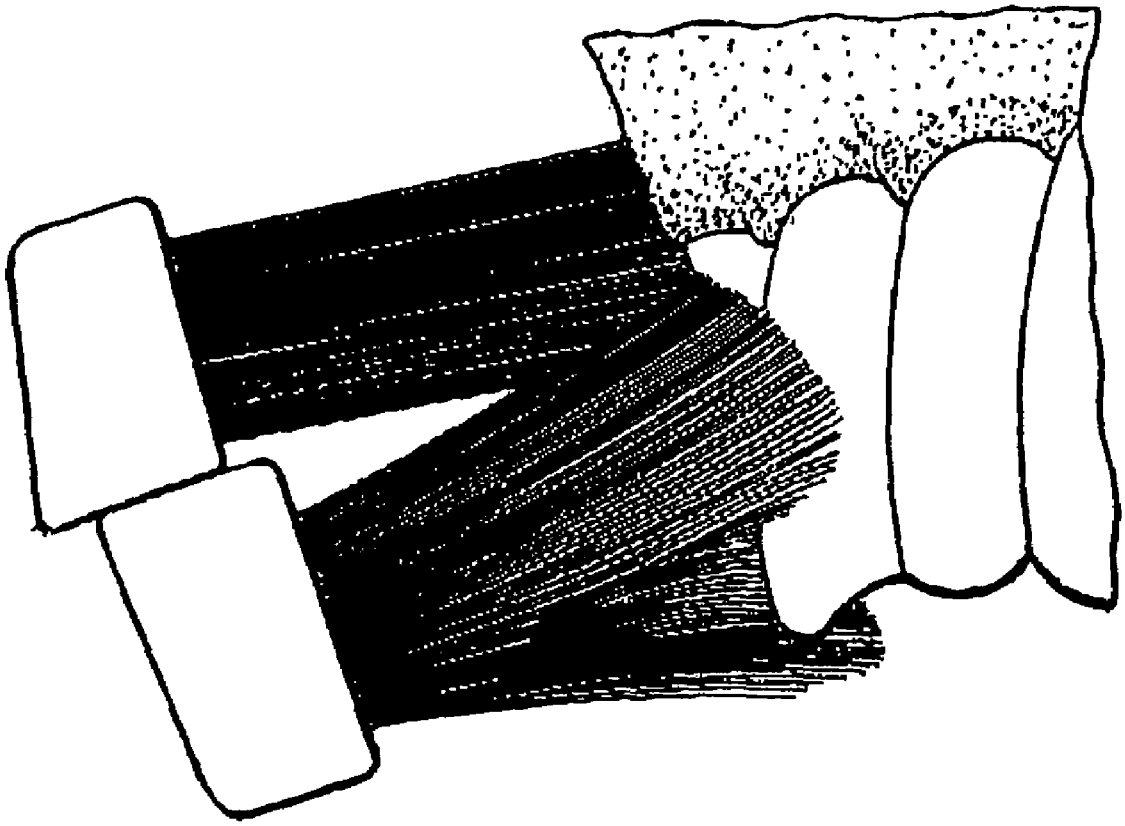
FIG. 9 shows the contour-adaptive-functioning of the toothbrush in FIG. 1.

FIG. 9 is an image of a double-headed toothbrush that meets the contour adaptive force measurements according to the principles of the present invention. As shown, the bristles on each head adapt to the contour of the teeth and gums. The heads may individually articulate or be deflected so that contour adaptivity is achieved when the individual bristle body masses are moved across the teeth and gums. Specifically shown are the inside-rows of bristles of each brush head and their orientation to contact the dento-gingival-junction.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A method for determining whether a double-headed toothbrush is contour adaptive, said method comprising:

providing a double-headed toothbrush composed of a pair of handles, necks, and heads each having a bristle body mass composed of bristles extending therefrom, each handle connected to respective necks, that connect to respective heads, each head having a tip on an end opposite the respective neck and handle, the handles of the double-headed toothbrush being rigidly connected to each other, securing the handles in a fixed position;

applying a first force (Y) onto a first neck or head substantially parallel to the bristles to deflect the tip to a first predetermined distance from a resting position;

measuring the first force (Y) applied to cause the tip to be deflected to the predetermined distance;

applying a second force (Z) to a bristle body mass extending from a head substantially perpendicular to the extended direction of the bristles to deflect the bristle body mass to a first predetermined bend percentage from a resting position;

measuring the second force (Z) applied to cause the bristle body mass to be bent to the first predetermined bend percentage;

applying a third force (X) to the bristle body mass extending from a head at a non-perpendicular direction to deflect the bristle body mass to a second predetermined bend pertentage from a resting position and the tip to a second predetermined distance from a resting position;

measuring the third force (X) applied to cause the bristle body mass to bend to the second predetermined bend percentage and to cause the tip to the second predetermined distance;

applying a fourth force (L) to a head substantially perpendicular to the direction of the bristle body masses to cause the tip to be deflected to a third predetermined distance from a resting position;

measuring the fourth force (L) applied to cause the tip to be deflected to the third predetermined distance; and determining if the toothbrush is contour adaptive based on the measured forces.

2. The method according to claim 1, wherein said securing includes locking the handle in a fixture.

3. The method according to claim 1, wherein said applying the first, second, third, and fourth forces includes utilizing a torque gauge.

4. The method according to claim 1, wherein the first predetermined distance is approximately ⅜ths of an inch.

5. The method according to claim 1, wherein the first predetermined bend percentage is approximately 50 percent.

6. The method according to claim 1, wherein the second predetermined distance is approximately ⅜ths of an inch.

7. The method according to claim 1, wherein the second predetermined bend percentage is approximately 50 percent.

8. The method according to claim 1, wherein the third predetermined distance is approximately ⅜ths of an inch.

9. The method according to claim 1, wherein said determining includes comparing the measured first, second, third, and fourth forces to respective ranges defining operating parameters of a contour adaptive toothbrush.

10. The method according to claim 9, wherein the respective range of the measured second force is between approximately 0.55 kg and approximately 3.89 kg of pressure force.

11. The method according to claim 9, wherein the respective range of the measured third force is between approximately 1.05 kg and approximately 2.35 kg of pressure force.

12. The method according to claim 9, wherein the respective range of the measured fourth force is between approximately 0.65 kg and approximately 3.77 kg of pressure force.

13. The method according to claim 9, wherein the respective range of the measured first force is between approximately 0.35 kg and approximately 3.68 kg of pressure force.

14. A method for determining whether a toothbrush is contour adaptive, comprising:

providing a toothbrush having a plurality of members, including at least one handle, neck, and head having a bristle body mass extending therefrom;

securing at least one portion of the toothbrush in a fixed position relative to a stationary object;

applying at least one force to at least one member of the toothbrush to cause a predetermined deflection of the at least one member of the toothbrush;

measuring the at least one force causing the predetermined deflection; and determining if the toothbrush is contour adaptive based on the measured at least one force.

15. The method according to claim 14, wherein said providing a toothbrush includes providing a double-headed toothbrush.

16. The method according to claim 15, wherein providing a double-headed toothbrush includes providing a double-headed toothbrush having a pair of handles, necks, and heads.

17. The method according to claim 14, wherein said applying at least one force includes applying a force to the head or neck of the toothbrush; and wherein said measuring the at least one force includes measuring the force applied to the head or neck of the toothbrush to cause the tip to be deflected to a predetermined distance.

18. The method according to claim 17, wherein the predetermined distance is ⅜ths of an inch.

19. The method according to claim 18, wherein said applying the at least one force includes applying the at least one force on a surface of the toothbrush on the same side as the bristles.

20. The method according to claim 18, wherein said applying the at least one force includes applying the force on a surface of the toothbrush perpendicular to the surface of the bristles.

21. The method according to claim 14, wherein said applying at least one force includes applying a force substantially perpendicular to the extended direction of the bristles of the toothbrush; and wherein said measuring the at least one force includes measuring the force applied to the bristles to deflect the bristles to a predetermined bend percentage from a resting position.

22. The method according to claim 21, wherein the predetermined bend percentage is approximately 50 percent.

23. The method according to claim 21, wherein said applying at least one force further includes applying a force to the bristles to cause the tip of the toothbrush to be deflected a predetermined distance.

24. The method according to claim 23, wherein the predetermined distance is ⅜ths of an inch.

25. The method according to claim 14, wherein said determining includes comparing the measured at least one force to respective ranges defining operating parameters of a contour adaptive toothbrush.

26. The method according to claim 25, wherein said applying at least one force to the at least one member of the toothbrush includes applying a force to the bristles of one head of the toothbrush at a non-parallel angle to the direction of the bristles toward the tip;

wherein said measuring the at least one force includes measuring the applied force to cause the bristles to bend a predetermined percentage and the tip to deflect by the predetermined percentage and the tip to deflect by the predetermined deflection; and wherein the comparing includes comparing the applied force to a range between approximately 1.05 kg and approximately 2.35 kg of pressure force.

27. The method according to claim 26, wherein the predetermined bend percentage is approximately 50 percent and the predetermined deflection is ⅜ths of an inch.

28. The method according to claim 25, wherein said applying the at least one force to the at least one member of the toothbrush includes applying a force to a head of the toothbrush perpendicular to the direction of the bristles;

wherein the comparing includes comparing the at least one force to a range between approximately 0.65 kg and approximately 3.77 kg of pressure force.

29. The method according to claim 28, wherein the predetermined deflection is approximately ⅜ths of an inch.

30. The method according to claim 14, wherein said applying at least one force to the at least one member of the toothbrush includes applying a force to one head or neck of the toothbrush parallel to the bristles extending from the head;

wherein said measuring the at least one force includes measuring the applied force to cause the tip to deflect by the predetermined deflection; and wherein the comparing includes comparing the applied force to a range of approximately 0.35 kg and approximately 3.68 kg of force.

31. The method according to claim 30, wherein the predetermined deflection is approximately ⅜ths of an inch from a resting position.

32. The method according to claim 31, wherein said applying at least one force to the at least one member of the toothbrush includes applying a force to the bristles of one head of the toothbrush and in parallel with the direction of the bristles;

wherein said measuring the at least one force includes measuring the applied force to cause the bristles to bend to a predetermined percent from a resting position; and wherein the comparing includes comparing the applied force to a range between approximately 0.55 kg and approximately 3.89 kg of pressure force.

33. The method according to claim 32, wherein the predetermined bend percentage is approximately 50 percent.

* * * * *